US007419000B1

(12) United States Patent
Marsh

(10) Patent No.: US 7,419,000 B1
(45) Date of Patent: Sep. 2, 2008

(54) APPARATUS AND METHOD FOR SECURING PIPES

(75) Inventor: Charles K. Marsh, Bridgeport, WV (US)

(73) Assignee: Quality Machine Company, Inc., Bridgeport, WV (US)

( * ) Notice: Subject to any disclaimer, the term of this patent is extended or adjusted under 35 U.S.C. 154(b) by 216 days.

(21) Appl. No.: 11/139,854

(22) Filed: May 26, 2005

Related U.S. Application Data

(60) Provisional application No. 60/574,877, filed on May 26, 2004.

(51) Int. Cl.
*E21B 19/16* (2006.01)
*E21B 19/10* (2006.01)

(52) U.S. Cl. ..... 166/77.51; 175/423; 285/123.5; 166/380

(58) Field of Classification Search ..... 175/423; 166/75.14, 75.51, 380; 285/123.5
See application file for complete search history.

(56) References Cited

U.S. PATENT DOCUMENTS 2,260,876 A * 10/1941 Wagner ..... 175/423
2,814,087 A * 11/1957 Palmer ..... 175/423
3,382,921 A * 5/1968 Todd ..... 166/348
3,457,605 A * 7/1969 Kingsbury et al. ..... 188/67
4,351,090 A * 9/1982 Clements et al. ..... 175/423
4,887,673 A * 12/1989 Skoruppa ..... 166/382
6,450,385 B1 * 9/2002 Guerin ..... 226/89
6,471,439 B2 * 10/2002 Allamon et al. ..... 403/374.1
6,948,575 B1 * 9/2005 Mosing et al. ..... 175/423
6,997,251 B2 * 2/2006 Baird ..... 166/77.51
7,134,531 B2 * 11/2006 Ramey et al. ..... 188/67
2003/0173117 A1 * 9/2003 Mason et al. ..... 175/423
2005/0155797 A1 * 7/2005 Campisi ..... 175/423

* cited by examiner

*Primary Examiner*—Shane Bomar
(74) *Attorney, Agent, or Firm*—Steptoe & Johnson PLLC

(57) ABSTRACT

An apparatus for holding in place a first casing while a second casing is connected to the first casing, including an annular clamp made up of three segments hingedly fit together to form a ring. The inner surface of each segment includes an insert within a dovetail which creates secure points of contact between the inner surface of the annular clamp and the exterior surface of the casing. The apparatus includes a carrier having two handles and a ring for transporting the annular clamp. The annular clamp can be positioned inside a bowl-shaped housing having a central circular opening adapted for receiving the annular clamp. An adapter plate can be used for retrofitting the apparatus to rigs of all makes and models.

9 Claims, 5 Drawing Sheets

APPARATUS AND METHOD FOR SECURING PIPES

CROSS REFERENCE TO RELATED APPLICATIONS

This application claims priority to U.S. Patent Application No. 60/574,877, which was filed May 26, 2004.

BACKGROUND OF THE INVENTION

1. Field of Invention

The present invention relates in general to wellhead equipment for oil and gas wells, and in particular to equipment for securing casing joints as they are coupled.

2. Related Art

A casing joint is a length of pipe, typically steel pipe about 30 feet to about 40 feet long having a threaded connection at each end. Casing joints are assembled to form a casing string that lines and stabilizes a wellbore. Casing is lowered into a wellbore and typically cemented in place. Generally, the diameter of the wellbore decreases at fixed points, called casing points, as the depth of the wellbore increases. When a casing point is reached in the wellbore drilling process, drilling ceases and casing of the necessary size is run, or lowered into place, and cemented.

Casing joints are usually assembled to form a casing string using casing couplings, or casing collars. A casing coupling is a short length of pipe having an inside diameter corresponding to the outside diameter of the casing joints and having internal threads, or female threadforms. Each casing joint has external threads, or male threadforms, at each end that are machined to match the internal threads of the casing joints. Accordingly, when running casing a first casing joint is typically held vertically in place as it extends partially into the wellbore, then a casing coupling is threaded onto the first casing joint, then a second casing joint is threaded into the casing coupling, then the assembly is lowered into the wellbore so that the procedure can be repeated as additional casing joints and casing couplings are added until the desired length is achieved. Casing joints may alternatively have male threadforms on one end and female threadforms on the other end such that multiple casing joints may be threaded directly into one another without the use of casing couplings. The process for running this type of casing is very similar to the aforementioned process.

The conventional method for holding the first casing joint in place as it is coupled with a second casing joint is to use cranes and winches in conjunction with human muscle power via the hands of the workers running the casing. This is problematic for at least two reasons, the first of which is that it is dangerous for workers to be placing their hands in and around an area where a rig is being used to rotate and secure a second casing to a first casing. The second reason is because the work is very labor-intensive and time consuming, thereby slowing the well drilling process and costing money. There thus is a need in the industry for an improved means for securing a first casing within a wellbore as a second casing is being secured thereto.

SUMMARY OF THE INVENTION

This invention solves the foregoing problems by providing an apparatus for securing a first casing in place while a second casing is connected thereto. The apparatus eliminates the need for one or more workers to hold the first casing manually with their hands while the second casing is being secured to the first.

One aspect of the invention is an apparatus for holding in place a first casing while a second casing is connected to the first casing, including an annular clamp having three segments hingedly fit together to form a ring; a carrier including two handles and a ring, wherein the carrier can be connected to a top surface of the annular clamp; a bowl-shaped housing including a central circular opening adapted for receiving the annular clamp; and an adapter plate adapted for receiving the bowl-shaped housing and further adapted for mounting the bowl-shaped housing to a rig. The adapter plate also can include a central circular opening through which a casing fits.

Another aspect of the invention is an apparatus for holding in place a first casing while a second casing is connected to the first casing, including an annular clamp having two or more segments hingedly fit together to form a ring through which a casing fits; and a bowl-shaped housing mounted to a rig and including a central circular opening adapted for receiving the annular clamp.

Another aspect of the invention is an apparatus, including an annular clamp having two or more segments hingedly fit together to form a ring through which a casing fits, wherein the ring has an adjustable inside diameter such that the ring holds a casing in place when the inside diameter is reduced by squeezing together the two or more segments.

Another aspect of the invention is a method for holding in place a first casing while a second casing is connected to the first casing, including mounting a bowl-shaped housing to a rig, wherein the bowl-shaped housing includes a central circular opening adapted for receiving an annular clamp; positioning an annular clamp inside the bowl-shaped housing, the annular clamp having two or more segments hingedly fit together to form a ring; and inserting a first casing through the ring formed by the two or more segments of the annular clamp.

A feature of the invention is an annular clamp with three segments hingedly fit together such that upon inserting the annular clamp inside a bowl-shaped housing the inside diameter of the annular clamp is reduced to secure a casing in place.

Another feature of the invention is one or more inserts detachably secured within dovetails on the inside surface of the annular clamp to form one or more points of contact with a casing.

Another feature of the invention is a carrier detachably connected to the annular clamp to facilitate lifting and lowering of the annular clamp.

Another feature of the invention is an air cylinder mechanically connected to an annular clamp for raising and lower the annular clamp into and out of a bowl-shaped housing.

Another feature of the invention is a universal bowl-shaped housing that accommodates annular clamps of various sizes.

Another feature of the invention is an adapter plate which allows the apparatus of the present invention to be retrofitted onto a drill rig.

An advantage of the invention is that makes securing casings together quicker and easier.

Another advantage of the invention is that it eliminates the need for one or more workers to hold a first casing with their hands while a second casing is connected to the first casing, thereby making the process safer.

Another advantage of the invention is the strength with which the annular clamp grips a casing.

Another advantage of the invention is that the carrier and the air cylinder make moving and positioning the annular chamber relatively easy.

Another advantage of the invention is that the exterior taper of the annular clamp, regardless of its size, matches the interior taper of the bowl-shaped housing, such that one bowl-shaped housing can be used with a variety of annular clamps each being of a different size.

Another advantage of the invention is that because the interior taper of the bowl-shaped housing matches the exterior taper of the annular chamber, the curved segments of the annular chamber are compressed and released as the annular chamber is inserted into and removed from the bowl-shaped housing, respectively.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

EMBODIMENTS OF THE INVENTION

Figure 1:
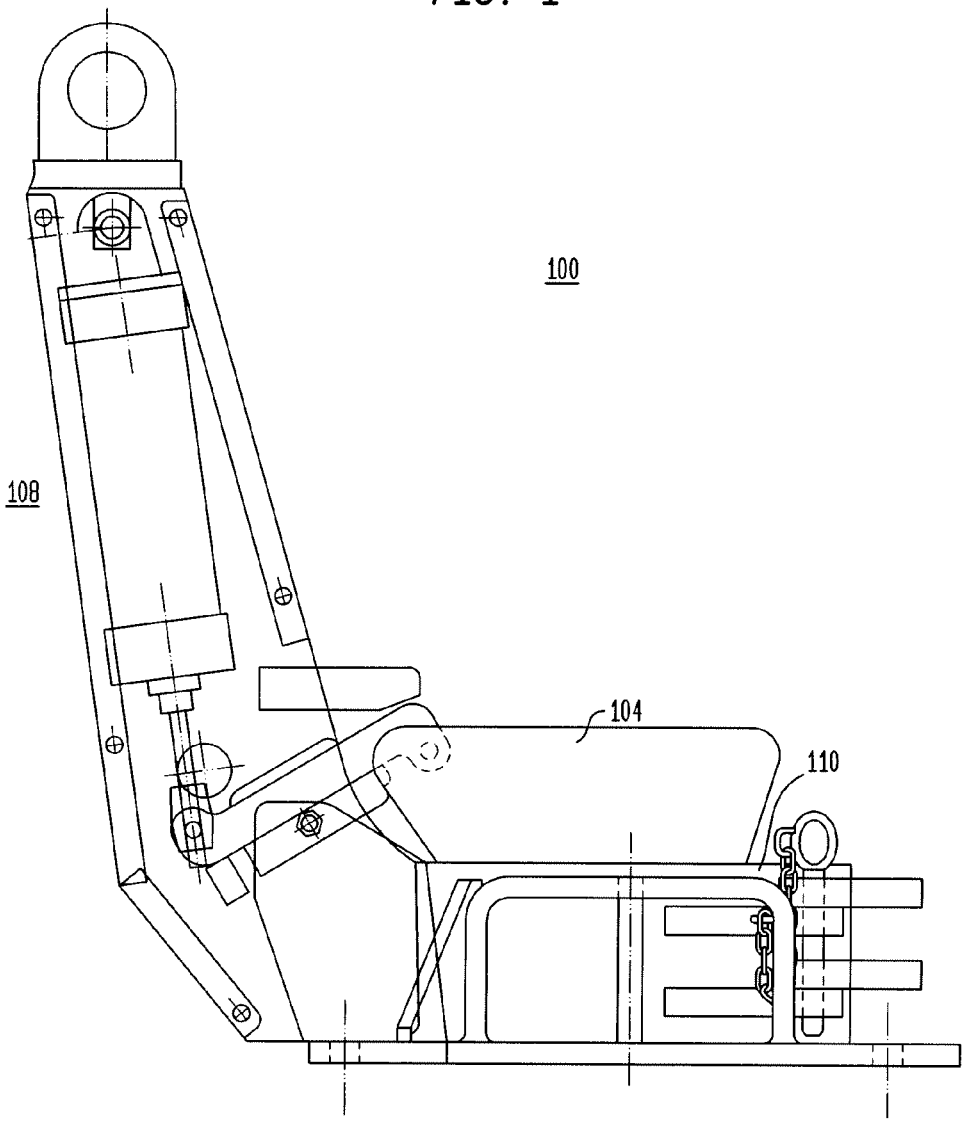
FIG. 1 is a side view of a bowl-shaped housing and a means for vertically positioning an annular clamp in the bowl-shaped housing.

The components of one possible embodiment of the present invention are shown generally in FIG. 1. More specifically, an apparatus for holding in place a first casing while a second casing is connected thereto (apparatus) 100 can include an annular clamp 102 comprising two or more segments hingedly fit together to form a ring through which a casing fits, and a bowl-shaped housing 104 for mounting the apparatus 100 to a rig and comprising a central circular opening adapted for receiving the annular clamp 102. The apparatus 100 can also include a carrier 106, a means for vertically positioning 108 the annular clamp 102 in the bowl-shaped housing 104, and/or an adapter plate 110. The apparatus 100 may sometimes be referred to commercially as an air slip assembly. For purposes of this disclosure, the terms casing joint, casing, and pipe are intended to mean the same thing and can be, and sometimes are, used interchangeably.

Annular Clamp

Figure 2A:
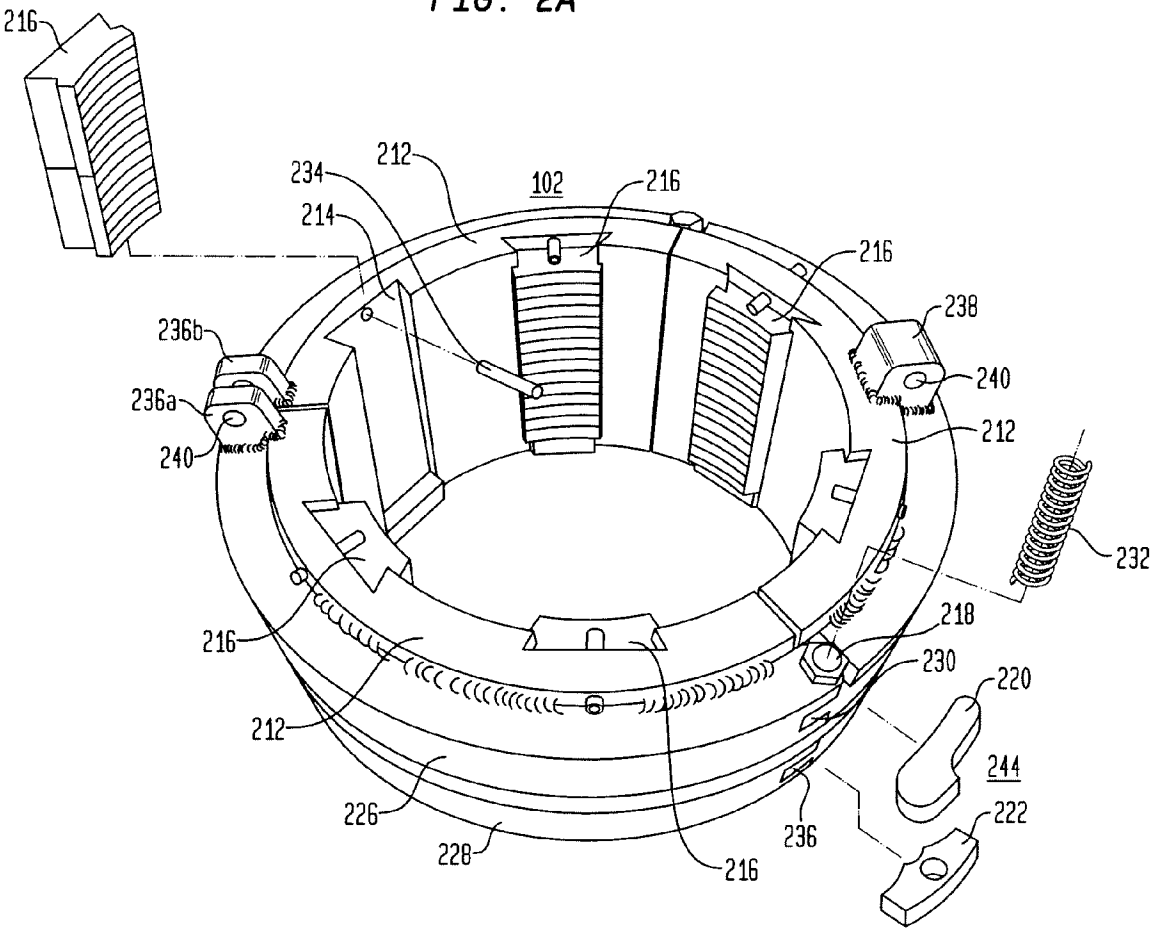
FIG. 2A is a detailed perspective view of an annular clamp.
Figure 2B:
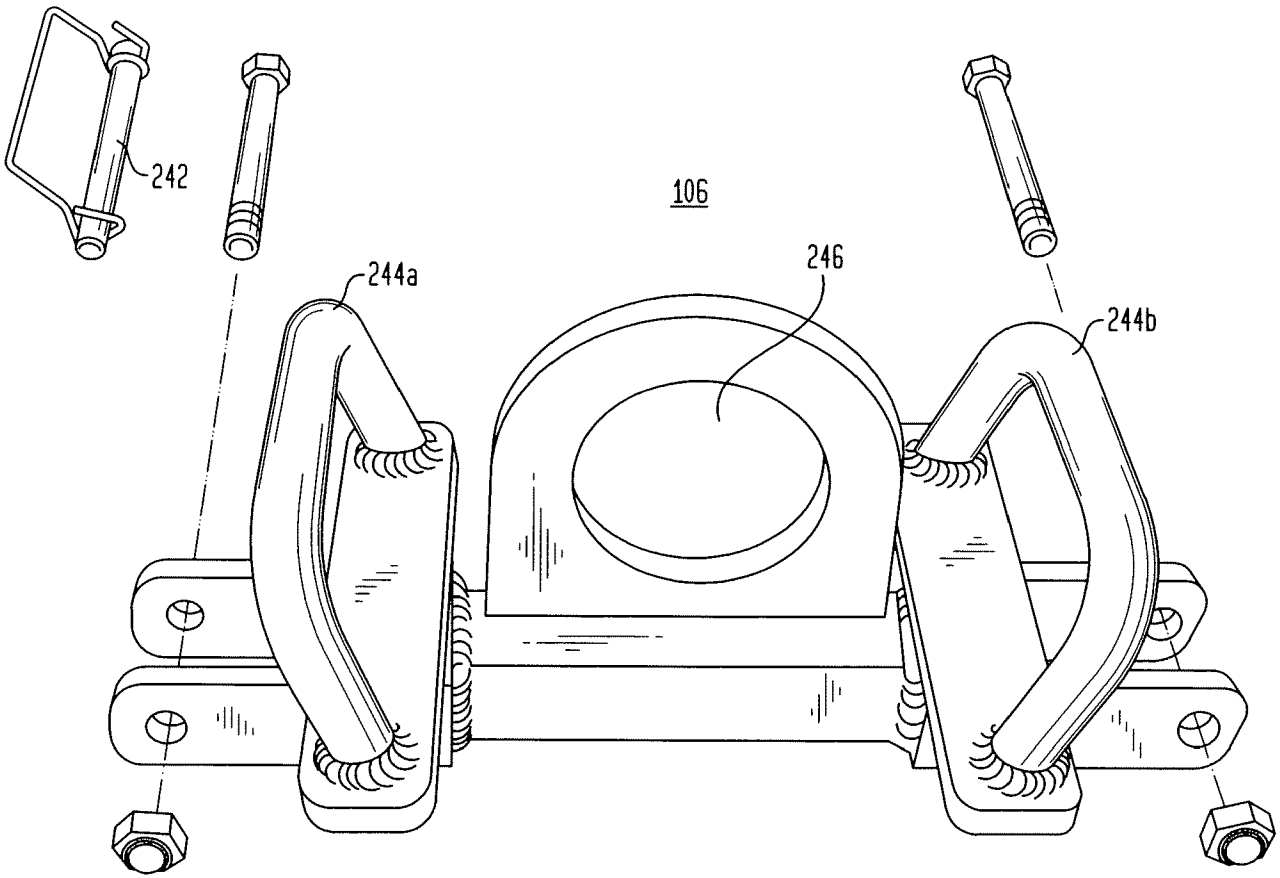
FIG. 2B is a detailed perspective view of a carrier.

Referring to FIG. 2, the annular clamp 102, or "spider" or "slip body," as it sometimes referred to, can have three curved segments 212 that fit together using male and female joints to form a complete ring. Each curved segment 212 can have at least one and sometimes two dovetails 214 on its inner surface into which an insert 216 can be placed. Each insert 216, in turn, has an inner surface that can serve as a point of contact between the annular clamp 102 and a casing joint. An insert 216 optionally can be permanently secured to the inner surface of a curved segment 212 by means known to those skilled in the art, such as by welding, or by using a permanent adhesive. Alternatively, the inserts 116 can be built into and actually be a part of a curved segment 212 by machining or other means known to those skilled in the art. However, each insert 216 preferably is detachably secured to a curved segment 212 by sliding the insert 216 into a dovetail 214 and securing the insert 216 thereto by inserting a pin 234 through a hole extending through the insert 216 and into the dovetail 214. The hole can be recessed into the surface of the insert 216 such that the pin 234 does not come into contact with a casing joint when a casing joint is inserted through an annular clamp 102.

The annular clamp 102 can include a front carrier lug 236 and a rear carrier lug 238 along its top surface to facilitate moving the annular clamp 102. The rear carrier lug 238 can be secured at about a mid-point along a top surface of a curved segment 212. A first front carrier lug 236 can be positioned near an end along a top surface of a curved segment 212 and a second front carrier lug 236 can be positioned near an end along a top surface of a curved segment 212 adjacent to the curved segment 212 containing the first front carrier lug 236. The first and second front carrier lugs 236 are positioned opposite the rear carrier lug 238 along the top of the annular clamp 102. Each of the first and second front carrier lugs 236 and the rear carrier lug 238 have a hole 240 extending therethrough for receiving a carrier safety clip 242 of a carrier 106. The carrier 106 can comprise two handles 244*a*, 244*b* and a ring 246. The carrier 106 can be secured to a top surface of the annular clamp 102 to facilitate lifting and moving the annular clamp 102 (see FIG. 3B).

Apparatus 100 of the present invention comprises a novel mechanism for connecting the three curved segments 212 that fit together to form the annular clamp 102. Previously, each curved segment would have had a male joint on one end and a corresponding female joint on the other end. This arrangement leads to inefficient and wasteful practices in the manufacturing process, however. To solve these problems, the apparatus 100 of the present invention uses a hinge pin 218 along with a connecting member 224 comprising a hinge ear 220 and a hinge stop 222 to flexibly connect each curved segment 212 to one another. More specifically, a connecting member 224 can be attached to each of two bands 226, 228, respectively, lining the outside of each curved segment 212 on one end of the bands 226, 228 such that the connecting members 224 project out and fit into recesses 230 in the end of the adjacent bands 226, 228. A hinge pin 218 can be placed down through holes in the ends of the adjacent bands 226, 228 as well as through a hole in the hinge ear 220 of the connecting member 224. There can be two connecting members 224 and one hinge pin 218 at each interface between two curved segments 212. The connecting members 224 and hinge pins 218 can be located near the outer perimeter of the annular clamp 102 such that the curved segments 212 can rotate outward about the hinge pins 218, thus opening up the annular clamp 102. One or more springs 232 may be used in conjunction with the hinge pins 218 and connecting members 224 to aid in such action.

Bowl-Shaped Housing

Figure 3A:
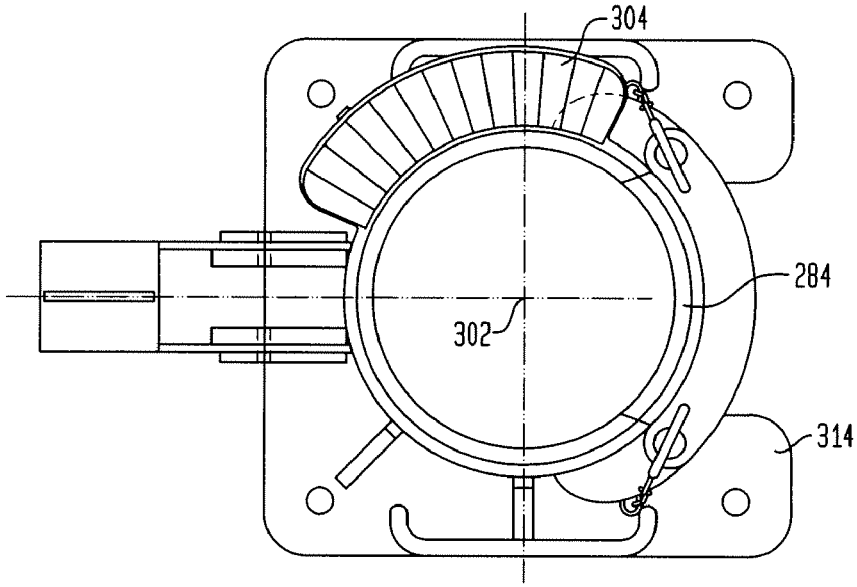
FIG. 3A is a top plan view of a bowl-shaped housing atop an adapter plate.

Referring to FIG. 3A, an annular clamp 102 can be used in conjunction with a bowl-shaped housing 104. The bowl-shaped housing 104 can comprise a central circular opening 302 adapted for accepting an annular clamp 102. The bowl-shaped housing 104 can further comprise two top flaring collars 304 designed to guide a first casing joint more easily down into the annular clamp 102. The bowl-shaped housing 104, in turn, can be attached to an adapter plate 110 having a central circular opening through which a casing fits. The bowl-shaped housing can have a base plate 314 which facilitates attaching of the bowl-shaped housing to the adapter plate 110.

The adapter plate 110 can be manufactured to accept a bowl-shaped housing 104 as well as to mount securely to a particular rig with which the apparatus 100 is intended to be used. Various sizes and shapes of adapter plates 110 corresponding to particular rig models can be used in order to maximize the potential applications for the apparatus 100 of the present invention. Alternatively, the apparatus 100 can be manufactured as part of a rig in which case no adapter plate 110 is necessary. Also, there can be instances in which the apparatus 100 can be secured to a rig without requiring an adapter plate 110 to do so.

Means for Raising and Lowering the Annular Clamp

Figure 3C:
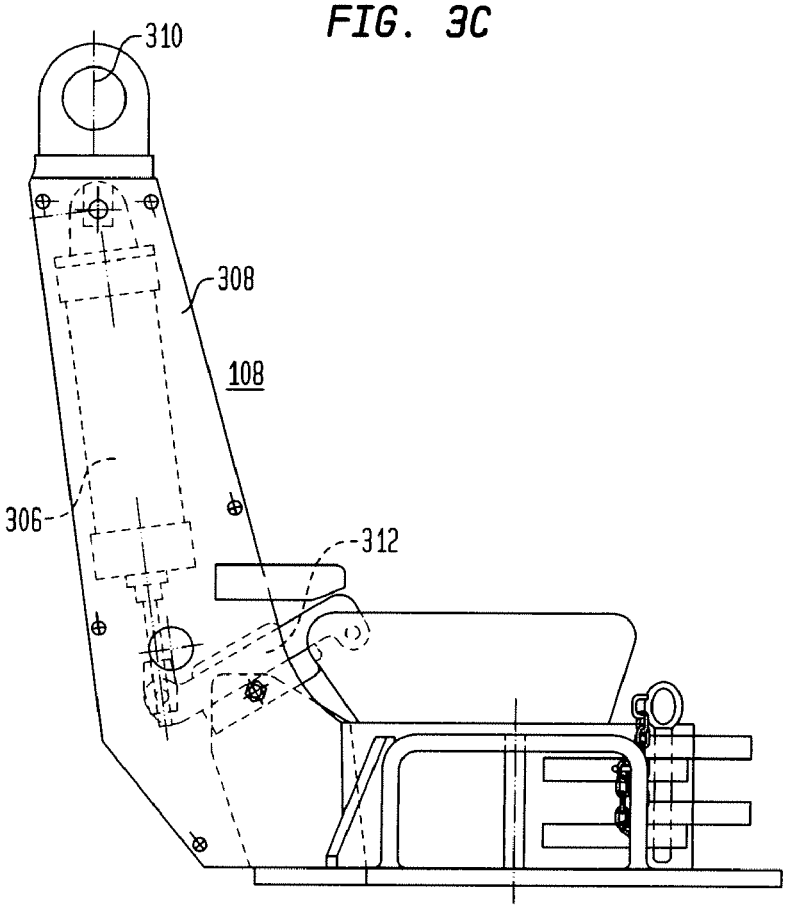
FIG. 3C is a side view of a means for vertically positioning an annular clamp in a bowl-shaped housing.
Figure 3B:
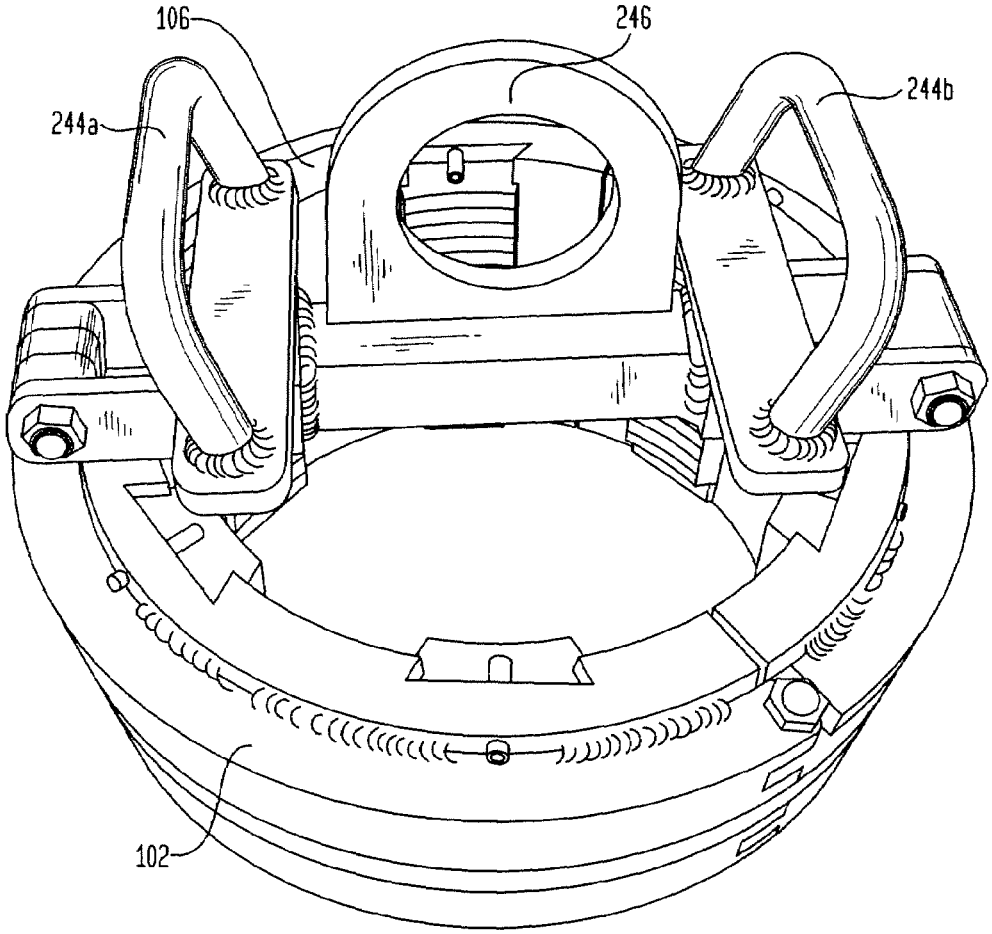
FIG. 3B is a perspective view of a carrier connected to an annular clamp.

Referring to FIG. 3C, the apparatus 100 of the present invention can include a means 108 for vertically positioning an annular clamp 102 in a bowl-shaped housing 104. The vertical positioning means 108 can include an air cylinder 306 within a tower 308. The tower 308 can comprise a lifting lug 310 at its top for raising and lower the tower 308. The air cylinder 306 can be mechanically connected by a lever or linkage 312 to the annular clamp 102. By raising or lowering the linkage 312 the annular clamp 102 likewise is raised or lowered.

In operation, a top head of a rig drills a hole by rotating and forcing a drill steel into the ground. Once a desired depth has been reached, the hole, which may become a well, is secured with casing. In order to place the casing in the hole, the rig is raised up and the drill steel is removed from the head. The apparatus 100 of the present invention can then be attached to the rig by securing the adapter plate 110, if one is needed, to the table on the rig. In alternative embodiments, the apparatus 100 of the present invention either may be manufactured as part of the rig, or it may retrofitted to the rig without the use of an adapter 110, in which case the base plate 314 of the bowl-shaped housing 104 is secured directly to the table of the rig. Once the bowl-shaped housing 104 is positioned, either with or without the use of an adapter 110, an annular clamp 102 can be positioned vertically near the top of the bowl-shaped housing 104. A first casing can be dropped into the hole through the annular clamp 102 and the central opening 302 of the bowl-shaped housing. The first casing can be positioned by attaching a first end of the casing to the head of the rig and lowering a second end of the casing into the hole as described above.

The vertical positioning means 108 can be used to position the annular clamp 102 within the bowl-shaped housing 104. More specifically, the annular clamp 102 can be raised up from or lowered down into the bowl-shaped housing 104 pneumatically by use of the air cylinder 306 and mechanical linkage mechanism 312. Alternative means may be used to raise the annular clamp 102, such as hydraulic or electric means. By using such means, the annular clamp 102 can be raised remotely rather than by hand and/or by winches which is inherently more dangerous for the workers. As the annular clamp 102 is raised, the curved segments 112 rotate about the connecting members 124 and the annular clamp 102 opens up and creates a larger diameter opening defined by the inner surfaces of the inserts 116. This allows a casing joint to be lowered into that opening. The annular clamp 102 can then be lowered by the vertical positioning means 108 into place within the bowl-shaped housing 104. Once the annular clamp 102 is lowered into the bowl-shaped housing 104, the curved segments 112 are squeezed together thereby closing the annular clamp 102 such that the inserts 116 tightly grip the casing joint and hold the casing joint in a fixed position. The three curved segments 112 thus are formed into a ring around the first casing joint such that the first casing joint is held fast in place by contact pressure with the inserts 112 of the annular clamp 102. The annular clamp 102 can be spring loaded such that a lifting lug 310 and linkage 312 working air cylinder 306 pneumatically raises and opens the annular clamp 102 or lowers and closes the annular clamp 102 when lift linkage 312 is pulled or pushed. A carrier 106 having two handles 144*a,b* and a ring 146 for attaching the hook of a crane, winch, or hoist, may be temporarily attached to the top of the annular clamp 102 to aid in moving the annular clamp 102.

Annular clamps 102 can be made to accommodate various sizes of casing, yet all preferably fit into one uniform size of bowl-shaped housing 104. Alternatively, a range of annular clamp sizes 102 may fit into one size of bowl-shaped housing 104, another range of annular clamp 102 sizes may fit into another size of bowl-shaped housing 104, etc. For example, one size bowl-shaped housing 104 can be made to accommodate various annular clamps 102 each of which are able to handle casings having an outside diameter of four inches, seven inches, eight and five-eighths inches, nine and five-eighths inches or eleven and three-fourths inches. To switch sizes to accommodate other casings, therefore, one need only switch one part, the annular clamp 102, rather than switching an entire assembled apparatus.

The apparatus 100 of the present invention thus can be used to immobilize a first casing joint as it is coupled with a second casing joint. Specifically, an annular clamp 102 firmly attached to a rig can immobilize a first casing joint so that a second casing joint can more easily be coupled thereto.

CONCLUSION

While various embodiments of the present invention have been described in this invention disclosure, it should be understood that they have been presented by the way of example only, and not limitation. It will be understood by those skilled in the art that various changes in form and details may be made therein without departing from the spirit and scope of the invention. Thus, the breadth and scope of the present invention should not be limited by any of the above-described exemplary embodiments, but should be defined in accordance with the described terms and their equivalents.

What is claimed is:

1. An apparatus for holding in place a first casing while a second casing is connected to the first casing, comprising:

an annular clamp comprising three curved segments hingedly fit together to form a ring;

a carrier comprising two handles and a ring, said carrier connected to a top surface of said annular clamp;

a bowl-shaped housing comprising a central circular opening adapted for receiving said annular clamp;

an adapter plate adapted for receiving said bowl-shaped housing and adapted for mounting said bowl-shaped housing to a rig, said adapter plate comprising a central circular opening through which a casing fits; and a base plate for securing said bowl-shaped housing to said adapter plate.

2. The apparatus of claim 1, further comprising a means for vertically positioning said annular clamp in said bowl-shaped housing.

3. The apparatus of claim 2, wherein said vertical positioning means is a gas cylinder, a hydraulic cylinder, or an electric motor, mechanically connected to said annular clamp.

4. The apparatus of claim 1, wherein each of said three curved segments comprises a dovetail adapted for receiving an insert.

5. The apparatus of claim 1, wherein said carrier is detachably connected to said annular clamp.

6. The apparatus of claim 1, wherein said annular clamp has an inside diameter, and further wherein said three curved segments of said annular clamp are squeezed together when said annular clamp is lowered into said bowl-shaped housing, thereby reducing the inside diameter of said annular clamp.

7. The apparatus of claim 6, wherein said three curved segments of said annular clamp hinge outwardly when said annular clamp is raised from said bowl-shaped housing, thereby increasing the inside diameter of sail annular clamp.

8. The apparatus of claim 1, wherein said bowl-shaped housing further comprises a flaring collar for guiding a first casing joint into said annular clamp.

9. The apparatus of claim 2, wherein said vertical positioning means comprises:

a tower;

an air cylinder housed within said tower; and linkage mechanically connecting said air cylinder to said annular clamp.

* * * * *